United States Patent [19]

Hild et al.

[11] 3,944,315

[45] Mar. 16, 1976

[54] ELECTRICAL TERMINAL MEANS

[75] Inventors: Henry F. Hild; John W. Stearley, both of Indiana, Pa.

[73] Assignee: Robertshaw Controls Company, Richmond, Va.

[22] Filed: Oct. 10, 1974

[21] Appl. No.: 513,536

[52] U.S. Cl. ..... 339/95 R; 339/246; 339/270 R

[51] Int. Cl.[2] ..... H01R 9/08; H01R 9/10

[58] Field of Search ..... 339/95, 246, 263, 266, 339/269–271; 85/50 R

[56] References Cited

UNITED STATES PATENTS

| | | | |
|---|---|---|---|
| 1,547,162 | 7/1925 | Bohlman | 85/50 R |
| 2,116,690 | 5/1938 | Woodings | 85/50 R |
| 2,138,026 | 11/1938 | Dempsey | 339/271 |
| 2,231,916 | 2/1941 | Jackson | 339/263 R |
| 3,238,496 | 3/1966 | Crowther | 339/246 |

FOREIGN PATENTS OR APPLICATIONS

| | | | |
|---|---|---|---|
| 415,174 | 6/1925 | Germany | 339/246 |
| 900,235 | 12/1953 | Germany | 339/269 |
| 847,427 | 9/1960 | United Kingdom | 339/263 R |
| 85,147 | 5/1965 | France | 339/263 R |

*Primary Examiner*—Roy Lake
*Assistant Examiner*—Neil Abrams
*Attorney, Agent, or Firm*—Candor, Candor & Tassone

[57] ABSTRACT

A control device having a housing provided with a terminal that has a threaded screw member with its shank threadedly carried thereby for lead attachment thereto between an enlarged head of the screw member and the terminal. A resilient retainer clip is disposed between the head of the screw member and the terminal, the clip initially being under compression between the head of the screw member and the terminal to tend to hold the screw member in its threaded relation with the terminal. A lead is subsequently disposed between the clip and the terminal, the clip thereafter being disposed in a deformed condition against the lead to hold the lead to the terminal. The clip has a plurality of slots in the deformable portion thereof to render the same more deformable.

13 Claims, 5 Drawing Figures

ELECTRICAL TERMINAL MEANS

This invention relates to a control device having improved means for attaching one or more external leads thereto as well as to an improved resilient terminal clip for such a control device or the like.

It is well known that various control devices have been provided wherein each has a terminal provided with a threaded screw member for attaching an external lead between the enlarged head of the screw member and the terminal upon tightening of the screw member toward the terminal.

However, it has been found accordingly to the invention of the copending patent application, Ser. No. 499,328, filed Aug. 21, 1974, that when the lead is relatively rigid, the same has a tendency to cause untightening of the screw member when the lead is subjected to impacts and the like whereby the subsequent untightening of the screw member permits the lead to become detached therefrom.

Also, it has been found, according to such copending patent application, that when such control device is being shipped and the like, the screw member itself tends to become untightened from the terminal due to vibrations and shocks and thereby sometimes becomes detached from the terminal and thus lost.

Accordingly, it is a feature of the invention of such copending patent application to provide improved lead attaching means which will eliminate one or both of the above-described disadvantages.

In particular, one feature of that invention is to provide a retaining clip which will be deformed against the lead in such a manner that the lead cannot cause untightening of the screw member.

Another feature of that invention is to provide a retaining clip for lead attachment purposes which will tend to hold the screw member in its assembled relation with the terminal even though the control device is subjected to impacts and shocks.

For example, one embodiment of that invention provides a control device having a housing provided with a terminal means having a threaded screw member with its shank threadedly carried thereby for lead attachment thereto between an enlarged head of the screw member and the terminal means. A resilient retainer clip is disposed between the head of the screw member and the terminal means, the clip initially being under compression between the head of the screw member and the terminal means to tend to hold the screw member in its threaded relation with the terminal means even though the control device is subjected to impacts and vibrations. A lead can subsequently be disposed between the clip and the terminal means, the clip thereafter being disposed in a deformed condition against the lead to hold the lead to the terminal means and prevent turning of the lead relative to the screw member so that the same cannot cause untightening thereof.

However, it has been found according to the teachings of this invention that the deformability of such terminal clip can be improved by providing a plurality of slot means through the deformable portion thereof and the edge means of such slot means actually digs into the lead to assure an impoved electrical connection therewith.

In particular, one embodiment of this invention provides a terminal clip that is substantially in a U-shape with an opening passing through the cross-member thereof to telescopially receive the shank of the screw member so that the legs can be disposed between the terminal means and the enlarged head of the screw member. The cross-member of the clip has a plurality of slot means therein to render the same more deformable so that when the lead is disposed between the terminal means the cross-member the cross-member can be deformed against the lead and the edge means of the slot means will dig into the lead.

Accordingly, it is an object of this invention to provide an improved control device having one or more of the novel features set forth above or hereinafter shown or described.

Another object of this invention is to provide an improved resilient terminal clip for such a control device or the like.

Other objects, uses and advantages of this invention are apparent from a reading of the description which proceeds with reference to the accompanying drawings forming a part thereof and wherein.

Figure 1:
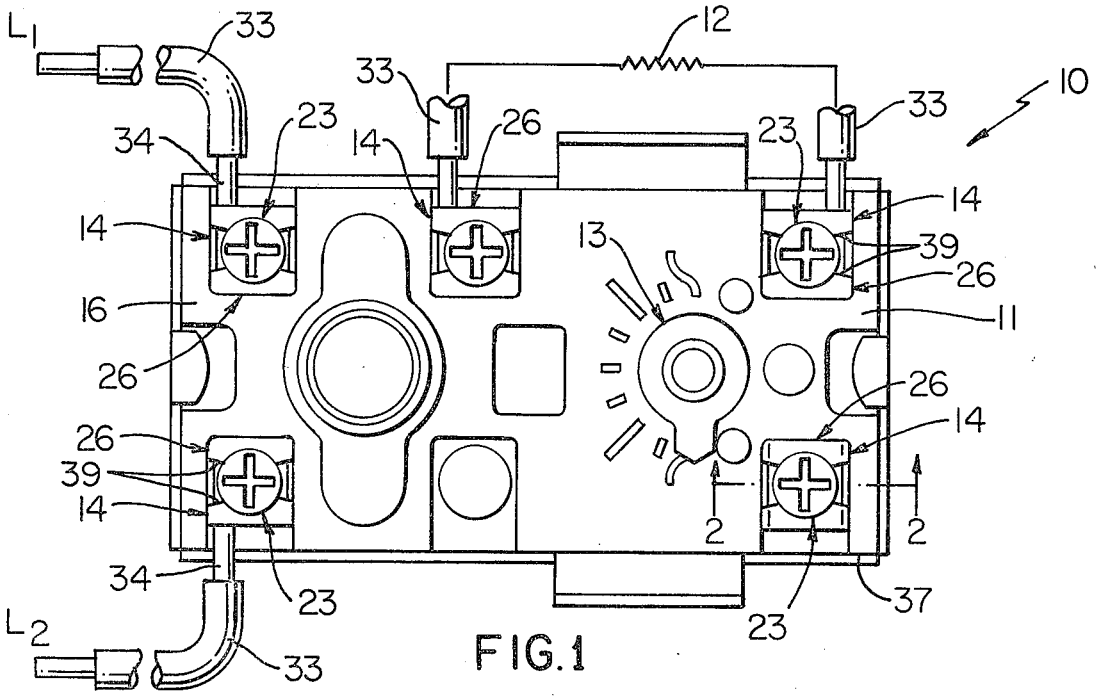
FIG. 1 is a top view of the improved control device of this invention.

While the various features of this invention are hereinafter described and illustrated as being particularly adapted to provided lead attachment means for a thermostat, it is to be understood that the various features of this invention can be utilized singly or in any combination thereof to provide lead attachment means for other types of control devices as desired.

Therefore, this invention is not to be limited to only the embodiment illustrated in the drawings, between the drawings are merely utilized to illustrate one of the wide variety of uses of this invention.

Referring now to FIG. 1, the improved control device of this invention is generally indicated by the reference numeral 10 and comprises a housing means 11 containing a thermostat structure (not shown) that is adapted to interconnect power source leads L1 and L2 to an electrically operated heater means 12 when the thermostat construction senses that the output temperature effect of the heater means 12 is below a selected temperature that has been selected by a selector knob 13 of the control device 10 and for disconnecting power source leads L1 and L2 from the heater means 12 when the output temperature effect sensed by the thermostat construction is above the selected temperature.

Figure 3:
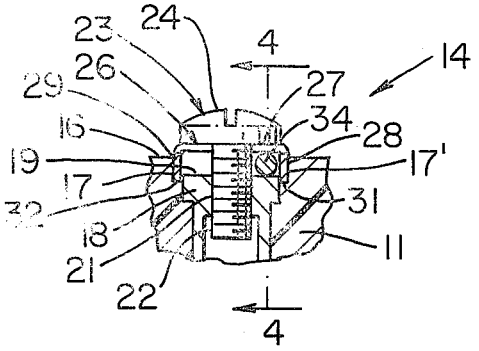
FIG. 3 is a view similar to FIG. 2 and illustrates the terminal means of FIG. 2 after a lead has been attached thereto.
Figure 4:
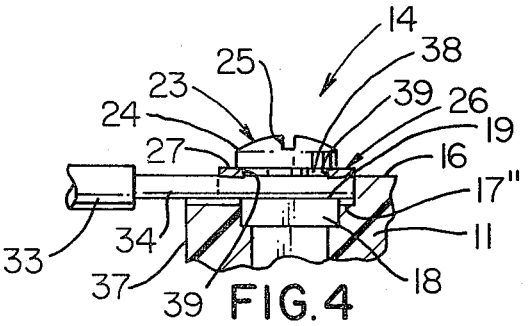
FIG. 4 is a fragmentary cross-sectional view taken on line 4—4 of FIG. 3 and illustrates how the edge means of the slot of the terminal clip dig into the lead.

In the particular embodiment of the control device 10, the control device 10 has five terminal means each generally indicated by the reference numeral 14 in the drawings and each being substantially identical in construction and each having the features of this invention. Accordingly, only one such terminal means 14 is illustrated in FIGS. 2–4 and will be hereinafter described in detail as it is to be understood that all of the other terminal means 14 of the control device 10 are constructed and operated in a like manner.

Figure 2:
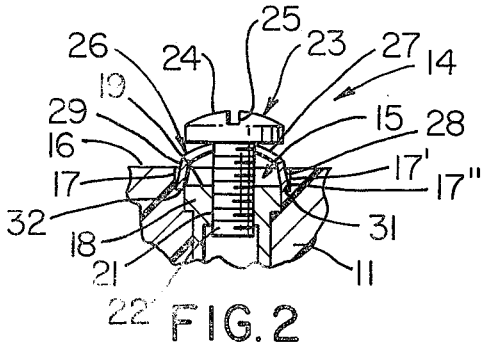
FIG. 2 is a fragmentary cross-sectional view taken on line 2—2 of FIG. 1 and illustrates the terminal means before a lead has been attached thereto.

As illustrated in FIG. 2, the housing means 11 is provided with a recess 15 in the top surface 16 thereof which leads to an outer side surface 37 of the housing 11 for a purpose hereinafter described, the recess 15 defining two spaced apart parallel side walls 17 and 17' for a purpose hereinafter described.

The housing 11 carries a conductive terminal means 18 that has a flat top surface means 19 exposed at the recess 15 and an internal part 20 leading to the interior of the housing means 11 for electrical connecting purposes to the structure of the previously described thermostat construction.

The upper surface 19 of the terminal means 18 is interrupted by a threaded bore 21 which threadedly receives an externally threaded shaft or shank portion 22 of a screw member 23 that has an enlarged head 24 provided with suitable notchings 25 to receive a screw driver or the like to tighten or untighten the screw member 23 relative to the terminal means 18 for a purpose hereinafter described.

A resilient retainer clip of this invention is generally indicated by the reference numeral 26 and is substantially U-shaped in cross section to thereby define a bowed or arcuate cross-member 27 and a pair of depending legs 28 and 29, the cross-member 27 of the clip 26 having an opening 30 of a generally circular configuration passing centrally therethrough to permit the same to telescopically receive in a loose manner the shank portion 22 of the screw member 23 in the manner illustrated in FIG. 2 whereby the lower ends 31 and 32 of the legs 28 and 29 of the clip 26 are adapted to rest against the top surface 19 of the terminal means 18 or, if the legs 28 and 29 of the clip are initially spaced apart a distance to be contained against the sides 17 and 17' of the recess 15 as illustrated, the legs 28 and 29 will have the ends 31 and 32 thereof contact the surface 17'' of the housing 11 outboard of the surface 19 of the terminal means 18.

In any event, before any external leads are interconnected to the respective terminal means 14 of this invention, the screw member 23 is tightened toward the terminal 18 to thereby compact the head 24 against the cross-member 27 of the clip 26 and thereby place the legs 28 and 29 under compression between the enlarged head 24 of the screw member 23 and the surface 19 of the terminal means 18 or the surface 17'' of the housing recess 15 so that the natural force of the thus-compressed clip 26 is to push outwardly on the enlarged head 24 of the screw member 23 in its threaded relation with the threads of the threaded bore 21 of the terminal 18.

In this manner, by thus preloading each spring clip 26 of the terminal means 14 of the control device 10, the compressed clips 26 tend to firmly hold the screw members 23 in place so that during subsequent shipping, etc., of the control device 10, vibrations and shocks will not cause the screw members 23 to tend to rotate in their untightening directions to therby become lost as the compression force of the clips 27 are continuously pushing outwardly on the enlarged heads 24 of the screw members 23 and thereby bind the same in their threaded relation with the internal threads of the terminal means 18 to prevent the same from rotating and thereby becoming untightened.

Figure 5:
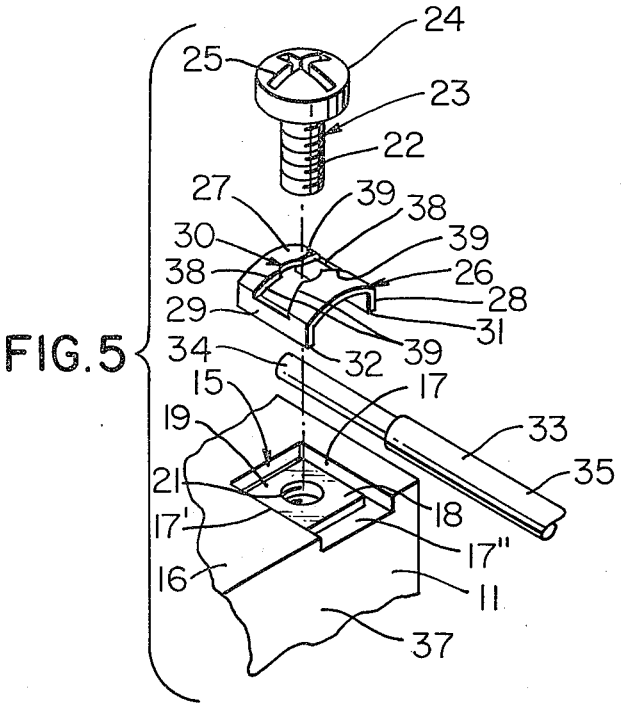
FIG. 5 is a fragmentary, exploded perspective view illustrating the improved terminal means of this invention.

When it is desired to attach an external lead to a particular terminal means 14 of the control device 10, such as the terminal means 14 illustrated in FIGS. 2–5, the external lead, such as lead 33 illustrated in FIG. 5 that has an end 34 thereof cleaned of its conventional insulation 35, has the bared end 34 inserted between the shank 22 of the terminal screw 23 and one of the legs 28 or 29 of the clip 26 in the manner illustrated in FIG. 3 where the lead end 34 is disposed between the shank 22 of the screw 23 and the leg 28 of the clip 26.

Thereafter, the screw member 23 is tightened downwardly toward the terminal means 18 whereby the enlarged head 24 of the screw member 23 deforms the cross-member 27 of the clip 26 downwardly and causes the legs 28 and 29 thereof to be compressed and bowed outwardly until the same are respectively fully engaged against the side walls 17 and 17' of the housing 11 as illustrated in FIG. 3 while the corss-member 27 is deformed down around and against the lead end 34 to positively hold the lead end 34 in firm electrical contact with the top surface 19 of the terminal means 18.

In this manner, the lead 33 cannot be rotated relative to the housing 11 as the lead end 34 is trapped along the leg 28 of the clip and the deformed part of the cross member 27 so that loosening of the screw member 23 cannot take place through impacts and shocks on the lead 33.

Further, because the clip 26 is still held under compression by the tightened screw member 23, the compressed clip 26 maintains an upward force on the enlarged head 24 of the screw member 23 to hold and bind the same in its threaded relation with the threads of the terminal means 18 in the same manner that the compressed clip 26 initially held the screw member 23 to the housing 11 before the lead 33 was attached thereto.

As previously stated, the cross member 27 of the clip is rendered more deformable by having a pair of slots 38 formed therethrough on opposite sides of the opening 30 while interconnecting therewith at the smaller bases of their generally trapizoidal configurations, the larger bases of the slots extending near the legs 28 and 29 of the clip 26. In this manner, not only is the cross member 27 more deformable, but also the edges 39 of the slots 28 actually cut or dig into the lead end 34 of the lead 33 as illustrated in FIG. 4 to assure good electrical contact therebetween when the cross member 27 is deformed against the lead end 34.

Therefore, it can be seen that all of the leads 33 can be readily attached to the control device 10 of this invention in the above manner by merely respectively inserting the bared ends 34 of the leads 33 into the spaces between the shanks 22 of the screw members 23 and either leg 28 or 29 of the clips 26 and through subsequent tightening of the screw members 23, the cross members 27 of the clips 26 can be deformed downwardly against the lead ends 34 to hold the leads 33 in good electrical contact with the terminal means 18 while preventing the leads 33 from rotating relative to the screw members 23 to unloosen the same as in the prior art arrangements.

Of course, when it is desired to remove the leads 33 from the terminals 14, the screw members 23 are untightened whereby the leads 33 can have the ends 34 thereof removed from underneath the cross members 27 of the clips 26 and new lead members can be attached thereto in the manner previously described.

Further, while only one lead is illustrated as being attached to each terminal means 14, it is to be understood that one or more leads can be attached by the clip 26 to the respective terminal means 18 as described.

Accordingly, it can be seen that this invention not only provides a control device having improved lead attaching means, but also this invention provides an improved resilient terminal clip for such a control device or the like.

While the form of this invention now preferred has been described and illustrated as required by the Patent Statute, it is to be understood that other forms can be utilized and still come within the scope of the appended claims.

What is claimed is:

1. In a control device having a housing provided with a terminal means having a threaded screw member with its shank threadedly carried thereby for lead attachment thereto between an enlarged head of the screw member and said terminal means, the improvement comprising a resilient retainer clip disposed between said head of said screw member and said terminal means, said clip having a portion provided with an opening therethrough and through which said shank of said screw member is telescopically disposed, a lead disposed between said portion of said clip and said terminal means, said portion of said clip being disposed in deformed condition against said lead by said head of said screw member to hold said lead to said terminal means, said clip having slot means passing through said portion thereof adjacent said opening to render said portion more deformable, said clip being in a substantially U-shape to define an initially bowed cross-member and a pair of legs thereof, said cross-member comprising said portion having said opening therethrough that telescopically receives said shank of said screw member, said legs of said U-shaped clip being disposed between said head of said screw member and said terminal means and being disposed on opposite sides of said shank of said screw member, said lead being disposed between one of said legs of said U-shaped clip and said shank of said screw member, said opening being substantially in the center of said cross-member and circular in configuration and said slot means comprising at least one slot that passes through said cross-member and being substantially trapezoidal in configuration with the smaller base thereof interconnecting with said opening and the larger base thereof being located at said one leg whereby said slot extends from said opening to said one leg and passes through said cross-member.

2. In a control device as set forth in claim 1, said slot means comprising a pair of said slots each being interconnected to said opening and being on opposite sides thereof.

3. In a control device as set forth in claim 1, said slot having edge means that digs into said lead when said portion of said clip is deformed against said lead.

4. In a control device as set forth in claim 3, said lead having a longitudinal axis and said edge means that digs into said lead being angular disposed relative to said axis.

5. In a control device as set forth in claim 1, said screw member being in a tightened condition toward said terminal means to cause said head thereof to compress said clip between said head and said terminal means to provide an initial holding of said screw member to said terminal means before said lead is disposed between said portion of said clip and said terminal means.

6. In a control device as set forth in claim 1, said screw member being in a tightened condition toward said terminal means to cause said legs of said clip to be under compression between said cross-member of said clip and said terminal means.

7. In a control device as set forth in claim 6, said screw member being in a tightened condition toward said terminal means to cause said head thereof to compress said cross-member of said clip toward said terminal means and thus against said lead to provide said deformed condition of said clip to hold said lead to said terminal means.

8. In a control device as set forth in claim 7, said housing having a recess adjacent said terminal means that defines a pair of spaced apart side walls adjacent said legs of said clip.

9. In a control device as set forth in claim 8, said tightened screw member having caused said legs of said clip to be bowed outwardly against said side walls of said housing.

10. A resilient terminal clip for a control device having a housing provided with a terminal means having a threaded screw member with its shank threadedly carried thereby for lead attachment thereto between an enlarged head of the screw member and said terminal means, said clip being adapted to be disposed between said head of said screw member and said terminal means, said clip having a portion provided with an opening therethrough and through which said shank of said screw member is adapted to be telescopically disposed so that a lead is adapted to be disposed between said portion of said clip and said terminal means, said portion of said clip being adapted to be disposed in deformed condition against said lead by said head of said screw member to hold said lead to said terminal means, said clip having slot means passing through said portion thereof adjacent said opening to render said portion more deformable, said clip being in a substantially U-shape to define an initially bowed cross-member and a pair of legs thereof, said cross-member comprising said portion having said opening therethrough that is adapted to telescopically receive said shank of said screw member, said legs of said U-shaped clip being adapted to be disposed between said head of said screw member and said terminal means and disposed on opposite sides of said shank of said screw member whereby said lead is adapted to be disposed between one of said legs of said U-shaped clip and said shank of said screw member, said opening being substantially in the center of said cross-member and circular in configuration and said slot means comprising at least one slot that passes through said cross-member and being substantially trapezoidal in configuration with the smaller base thereof interconnecting with said opening and the larger base thereof being located at said one leg whereby said slot extends from said opening to said one leg and passes through said cross-member.

11. A resilient terminal clip as set forth in claim 10 wherein said slot means comprises a pair of said slots each being interconnected to said opening and being on opposite sides thereof.

12. A resilient terminal clip as set forth in claim 10 wherein said slot means has edge means that are adapted to dig into said lead when said portion of said clip is deformed against said lead.

13. A resilient terminal clip as set forth in claim 12 wherein said edge means that is adapted to dig into said lead will be angular disposed relative to the longitudinal axis of said lead.

* * * * *